United States Patent [19]

Hauser

[11] 4,379,601

[45] Apr. 12, 1983

[54] SEWING MACHINE CRADLE SAFETY INTERLOCK

[75] Inventor: William G. Hauser, Fanwood, N.J.

[73] Assignee: The Singer Company, Stamford, Conn.

[21] Appl. No.: 244,376

[22] Filed: Mar. 16, 1981

[51] Int. Cl.[3] ..... A47B 81/00

[52] U.S. Cl. ..... 312/21; 312/22; 312/30

[58] Field of Search ..... 312/21, 22, 23, 26, 312/30, 208, 216, 333, 348; 292/DIG. 4; 112/217.1

[56] References Cited

U.S. PATENT DOCUMENTS

| | | | |
|---|---|---|---|
| 1,299,143 | 4/1919 | De Voe | 112/217.1 |
| 1,932,744 | 10/1933 | Lambert | 312/30 |
| 2,589,393 | 3/1952 | James | 312/30 |
| 2,700,585 | 1/1955 | Strocco | 112/217.1 |
| 2,874,014 | 2/1959 | Perrinjaquet | 312/30 |
| 3,788,716 | 1/1974 | Roberts et al. | 312/208 |
| 3,823,993 | 7/1974 | Kakishima et al. | 312/30 |
| 3,830,554 | 8/1974 | Moussaian et al. | 312/30 |
| 3,870,386 | 3/1975 | Shepherd | 312/21 |
| 4,111,503 | 9/1978 | Kohara | 312/30 |

*Primary Examiner*—Victor N. Sakran

*Attorney, Agent, or Firm*—William V. Ebs; Robert E. Smith; Edward L. Bell

[57] ABSTRACT

An interlock mechanism for a sewing machine cabinet of the drop head type that prevents the inadvertent unlatching of the sewing machine support platform prior to pivoting hinged panels out of the way thereby preventing damage to the sewing machine and panels.

5 Claims, 5 Drawing Figures

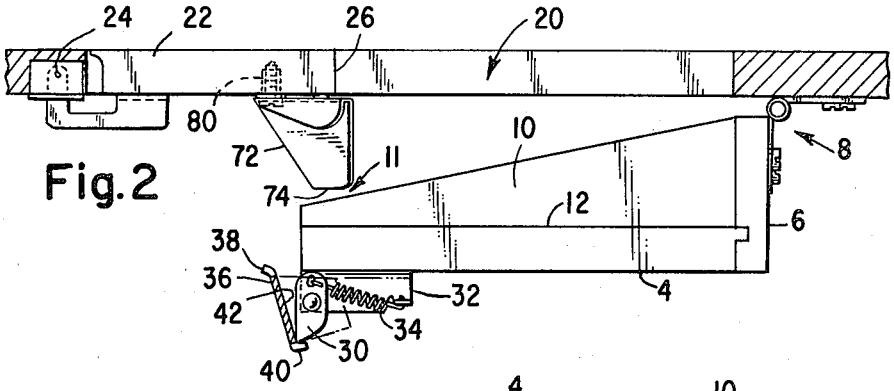
Fig.2
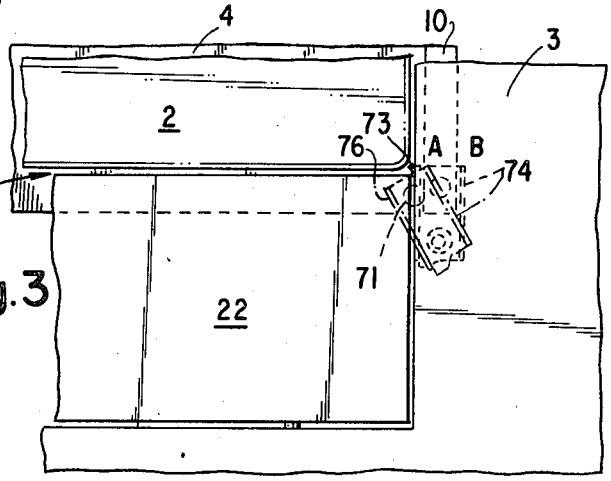
Fig.3
Fig.4
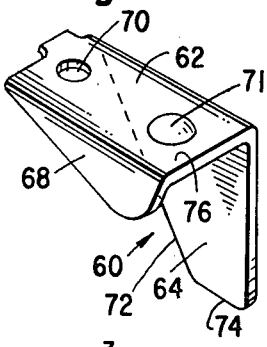
Fig.1A
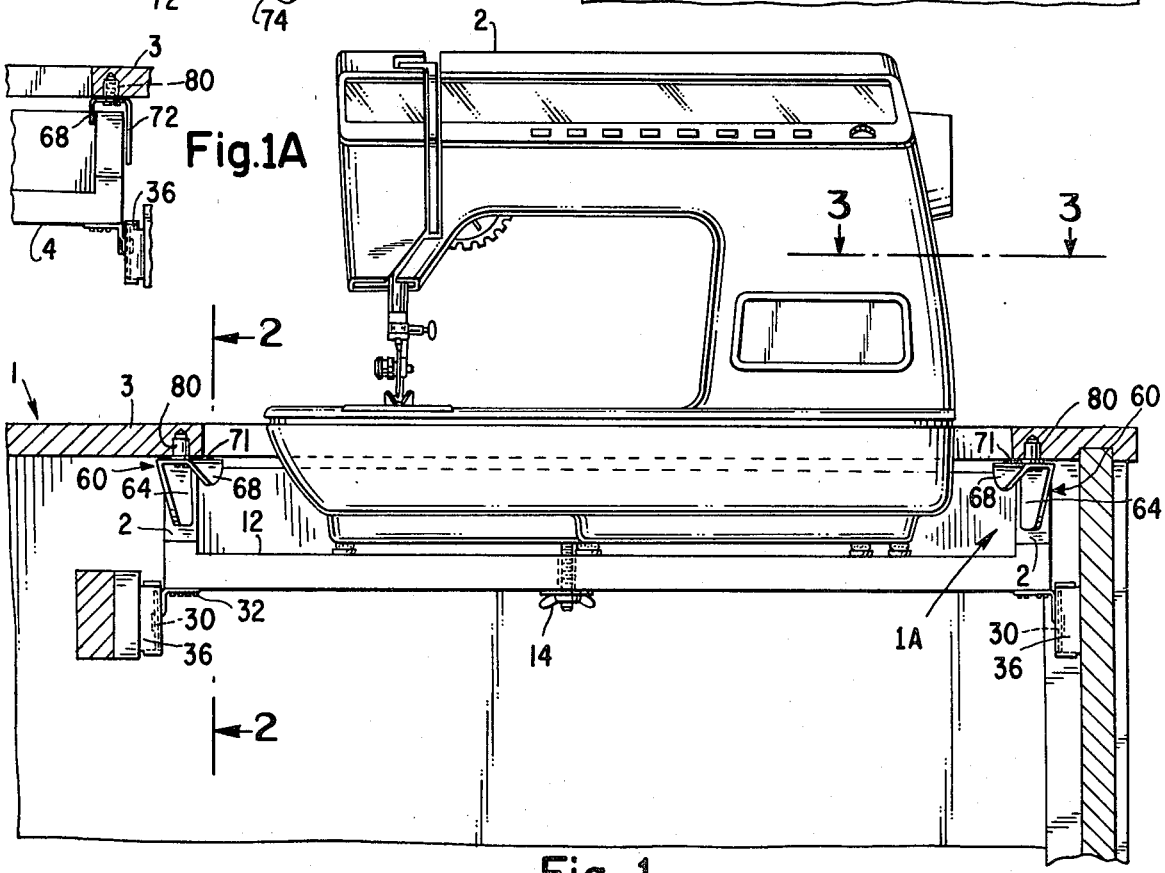
Fig. 1

SEWING MACHINE CRADLE SAFETY INTERLOCK

DESCRIPTION

BACKGROUND OF THE INVENTION

This invention relates to a sewing machine cabinet of the drop head type and more particularly to a mechanism for preventing the unlocking of the machine support platform when in the operative position.

In sewing machine cabinets of the drop head type, the sewing machine support platform is usually manually lifted into the operating position and lowered to its stored position within the cabinet. Means is provided for releasably securing the platform in the operating position. The prior art discloses various arrangements for accomplishing this result. One such arrangement utilizes a catch plate rigidly attached to the sewing machine cabinet and an interacting latch pivotally attached to the machine support platform. The latch is biased into wedging engagement with the catch plate when the machine is in operating position. When storing the machine, it is first pivoted upwardly so that the latch rides up and over the top of the catch plate and out of wedging engagement. The machine and support platform may then be lowered into the stored position. This type of construction is disclosed in U.S. Pat. No. 3,823,993, July 16, 1974, Kakishima et al, the teachings of which are incorporated herein by reference. Another such arrangement, but of somewhat different construction, is disclosed in U.S. Pat. No. 3,830,554, Aug. 20, 1974, Moussaian et al, the teachings of which are incorporated herein by reference. Moussaian discloses a sewing machine cabinet of the drop head type having a pair of bolts mounted on opposite sides of the platform which are received within sockets formed on corresponding keepers pivotally mounted on the cabinet side walls. To place the machine and platform into storage, the platform is pivoted upwardly until the bolts engage an upper surface of the keepers causing them to pivot thereby disengaging the bolts from the sockets. The machine and platform may then be lowered into the stored position. Both of these arrangements utilize one or more hinged flaps which abut the machine when in the operative position. Prior to placing the sewing machine in the stored position, these hinged flaps must be pivoted out of the way to provide sufficient clearance for the machine. A serious difficulty with this construction is evident when one unlatches the mechanism by pivoting the machine upwardly without moving the hinged flaps out of the way. The machine can then be released causing damage to both the machine and the flaps.

The present invention overcomes this disadvantage through the use of a novel but simple mechanism.

SUMMARY OF THE INVENTION

It is an object of this invention to prevent damage to the sewing machine and the hinged flap by inadvertent or deliberate release of the platform latch while the hinged flap is still in the operative position.

It is another object of this invention to provide a safety interlock mechanism whereby the machine support platform may not be unlatched without first pivoting the hinged flap out of the way.

It is another objective of this invention to provide a safety interlock mechanism that serves both as a flap rest and a constraining device limiting the movement of the support platform.

Other objects and advantages of the invention will become apparent through reference to the accompanying drawings and descriptive matter which illustrates a preferred embodiment of the invention.

According to the present invention, there is provided a cabinet for a sewing machine having a top surface provided with an opening through which a sewing machine may project. A sewing machine support platform is arranged within the opening and movable with respect to the top surface into either a first position substantially horizontal to the top surface for sewing, or a second position substantially vertical to and beneath the top surface for storing the sewing machine when not in use. A latch means is provided for releasably securing the support platform in the first position. The latch means is capable of being unlatched by raising the support platform a predetermined amount with respect to the top surface. A flap is hingably attached to the cabinet and disposed within the opening. It is pivotable from a position substantially coplanar with the top surface to positions approximately 90 degrees above and 90 degrees below the top surface. An interlock means is provided for selectively supporting the flap in its coplanar position while concurrently preventing the unlatching of the support platform.

BRIEF DESCRIPTION OF THE DRAWINGS

In order that the invention be more fully understood, it will be described by way of example with reference to the accompanying drawings in which:

FIG. 1 is a front view in section of a sewing machine cabinet and sewing machine showing a preferred embodiment of the present invention;

FIG. 1A is a partial view taken from 1A in FIG. 1 showing the invention in another operative state;

FIG. 2 is a side view in section taken along lines 2—2 in FIG. 1;

FIG. 3 is a partial top view taken along lines 3—3 in FIG. 1.

FIG. 4 is a perspective view of interlocking means according to the invention.

DESCRIPTION OF THE PREFERRED EMBODIMENT

Referring to FIGS. 1 through 3, there is shown a sewing machine cabinet 1 having a work supporting top surface 3 and a sewing machine 2 disposed therein. A machine support platform 4 having a back portion 6 is hingably attached to the work supporting surface 3 as shown at 8. The machine support platform 4 is of rectangular shape and has a gusset 10 positioned at each end as shown in FIG. 2. The machine support platform 4 has an upper surface 12 upon which the sewing machine 2 rests. A suitable fastening device 14 is utilized to hold the machine into position. An opening 20 is provided in the work supporting top surface 3 through which the sewing machine 2 projects. A flap 22 is hingably attached to the work supporting top surface 3 at 24. The flap 22 has an edge 26 which, when the flap 22 is positioned coplanar with the work supporting top surface 3, closely approaches the front edge of the base of the sewing machine 2 as shown in FIG. 3 at 27. There is sufficient clearance along this edge to permit pivoting the flap 22 upwardly about the hinge point 24 thereby providing sufficient clearance in front of the machine for pivoting the support platform 4 about the hinge point at 8 and lowering the sewing machine into its stored position within the cabinet.

A latch 30 is pivotally attached to a bracket 32 which is rigidly fastened to the machine support platform 4. The latch 30 is pivotally biased in a clockwise direction by the spring 34 as viewed in FIG. 2. A keeper 36 is rigidly attached to the cabinet 1 and is positioned to wedgingly receive the latch 30 as shown in FIG. 2. The spring 34 supplies sufficient bias to maintain the latch 30 and keeper 36 into wedging engagement so that the upper surface 12 of the machine support platform 4 is maintained parallel to the work supporting top surface 3. For lowering the machine support platform 4 into its stored position, the latch mechanism is unlatched by simply raising the machine support platform along a vertical path by pivoting about the hingepoint 8 until the latch 30 clears the upper part 38 of the keeper 36. The spring 34 then causes the latch 30 to rotate approximately 90 degrees clockwise at which point the machine support platform 4 is lowered. The latch 30 then engages the upper part 38 and slides down the surface 42 thereby rotating further clockwise until the latch 30 clears the underside 40 of the keeper 36. The latch 30 will then rotate counterclockwise under the biasing influence of the spring 34 until it is approximately horizontal to the machine support platform 4 and in a free state of equilibrium. When raising the machine support platform 4 from its stored position, it is pivoted about the hinge point 8 clockwise, as viewed in FIG. 2. The latch 30 engages the lower end 40 and is thereby caused to pivot counterclockwise against the biasing influence of the spring 34. Pivoting of the support platform 4 continues until the latch 30 clears the lower end 40 of the keeper 36 and engages the camming surface 42 of the keeper 36. The biasing spring 34 will urge the latch into wedging engagement with the keeper 36 thereby releasably securing the support platform 4 in the operating position.

An interlocking member 60, shown in FIG. 4, has a plate 62, a downwardly projecting leg 64 formed orthogonal to the plate and a pull tab 68. As best seen in FIG. 1, two interlocking members 60, each a mirror image of the other, are pivotally mounted to the cabinet 1 in two places by shoulder screws 80. A mounting hole 70 is provided in one extremity of the plate 62 for this purpose. A spherical projection 71 is formed in the surface of the plate 62 near the extremity furthest from the mounting hole 70. The edge 72 of the leg 64, as seen in FIG. 2, starting at the extremity of the plate 62 closest to the hole 70 is tapered down and toward the other edge of the leg 64 and terminates in an abutting surface 74. Each of the interlocking members 60 may be placed in either of two operating positions, A or B, see FIG. 3. When in position A the corner 76 of the interlocking member 70 projects beneath and supports the weight of the flap 22 and the spherical projection 71 nestles into the space 73 between the flap 22 and the work support top surface 3. Additionally, the abutting surface 74 obstructs movement of the platform 4 in the vertical path by being positioned immediately above the gusset 10 as shown in FIG. 2 at 11. The clearance between the abutting surface 74 and the gusset 10 when in this position is sufficiently small so that, should the platform 4 be raised until the gusset engages the abutting surface 74, the latch 30 will not clear the top of the keeper 36 thereby preventing unlatching of the mechanism. When the interlocking member 60 is placed in position B, as shown in FIG. 3, the abutting end 74 is no longer positioned directly over the gusset 10 but is now located alongside of it. This allows the platform 4 to be raised sufficiently to disengage the latch mechanism and allow movement of the platform 4 downward into its stored position. Note that with the interlocking member 60 in position B, the corner 76 no longer supports the flap 22, therefore, should the machine be lifted thereby unlatching the mechanism and lowered without raising the flap, the flap 22 simply hinges downward along with the sewing machine and support platform 4 causing no damage to either.

The advantages realized by this unique structure are quite important. The interlock device disclosed herein may be used with most any latch of the lift-to-release type, wherein premature unlatching is effectively obviated whether inadvertent or deliberate.

Upon reviewing the present disclosure, a number of alternative constructions will occur to one skilled in the art. Such constructions may utilize various shapes for the interlock member and various arrangements for pivoting, sliding, tilting or otherwise moving the member into and out of position for concurrently supporting the hinged flap and preventing the unlatching of the sewing machine support platform. Such alternative constructions are considered to be within the spirit and scope of this disclosure.

I claim:

1. A cabinet for a sewing machine having a top surface provided with an opening through which a sewing machine may project, a sewing machine, a platform having the machine mounted thereon and being movable with respect to said top surface into either a first position within said opening below the level of the said top surface and substantially horizontal for sewing, or a second position extending downwardly under said top surface for storing the sewing machine when not in use, latch means with mutually engagable parts on the cabinet and said platform for selectively retaining the platform in said first position, the latch means being capable of being unlatched by raising said platform a predetermined amount from the said first position, a flap hingably attached to the cabinet and disposed within said opening, said flap being movable with respect to said top surface from a position substantially coplanar with said top surface to positions approximately 90 degrees above and 90 degrees below said top surface, and interlock means mounted on the cabinet for movement into and out of a position wherein the interlocking means supports said flap in the said position substantially coplanar with said top surface and wherein the interlocking means interferes with upward movement of the platform by said predetermined amount to prevent the unlatching of said latch.

2. A cabinet as set forth in claim 1 wherein said interlock means comprises an L shaped member attached to said cabinet and arranged for pivotal movement with respect thereto and having a downwardly projecting leg portion to interfere with upward movement of the platform.

3. A cabinet as set forth in claim 1 wherein said interlock means includes a tab formed therein for effecting said pivotal movement by the operator.

4. A cabinet as set forth in claim 3 wherein said L shaped member includes a projection for engaging and supporting said flap when said flap is in said position substantially coplanar with said top surface.

5. A cabinet as set forth in claim 1 wherein said flap has an edge which substantially abuts said sewing machine when the said platform is in said first position.

* * * * *